US011116690B1

(12) United States Patent
Corcoran

(10) Patent No.: US 11,116,690 B1
(45) Date of Patent: Sep. 14, 2021

(54) APPARATUS AND METHOD FOR MYOFASCIAL TISSUE RELEASE

(71) Applicant: Arlene G. Corcoran, Tucson, AZ (US)

(72) Inventor: Arlene G. Corcoran, Tucson, AZ (US)

( * ) Notice: Subject to any disclaimer, the term of this patent is extended or adjusted under 35 U.S.C. 154(b) by 526 days.

(21) Appl. No.: 16/107,775

(22) Filed: Aug. 21, 2018

Related U.S. Application Data

(60) Provisional application No. 62/548,285, filed on Aug. 21, 2017.

(51) Int. Cl.
*A61H 15/00* (2006.01)
*A61H 7/00* (2006.01)
*A61H 39/04* (2006.01)

(52) U.S. Cl.
CPC ..... *A61H 7/007* (2013.01); *A61H 15/00* (2013.01); *A61H 39/04* (2013.01); *A61H 2015/0014* (2013.01); *A61H 2201/0119* (2013.01); *A61H 2201/1253* (2013.01); *A61H 2205/06* (2013.01); *A61H 2205/10* (2013.01)

(58) Field of Classification Search
CPC .... A61H 2015/0014; A61H 2201/1253; A61H 2205/06; A61H 15/0092; A61H 15/00
USPC ..... D24/211–212
See application file for complete search history.

(56) References Cited

U.S. PATENT DOCUMENTS 1,978,244 A * 10/1934 Bach ..... A63B 23/10 606/237
2,638,089 A * 5/1953 Murphy ..... A61H 15/00 601/27
2,638,098 A * 5/1953 Toepper ..... G06K 21/02 209/609
2,939,455 A * 6/1960 Arnold ..... A61H 15/0078 601/127
D253,967 S * 1/1980 Miyadai ..... D21/685
D255,835 S * 7/1980 Bentsen ..... D24/212
4,832,006 A * 5/1989 Kirsch ..... A61H 1/008 601/122
5,005,560 A * 4/1991 Quam ..... A61H 15/00 601/113
D396,295 S * 7/1998 Summers ..... D24/211
D405,887 S * 2/1999 Antoskow ..... D24/211
D405,888 S * 2/1999 Antoskow ..... D24/211
8,360,940 B2 * 1/2013 Kole ..... A63B 23/10 482/121
2007/0129654 A1 * 6/2007 Anderson, Jr. ..... A61H 15/00 601/119

(Continued)

*Primary Examiner* — Jan Christopher L Merene
*Assistant Examiner* — Nathan M Le
(74) *Attorney, Agent, or Firm* — Hayes Soloway P.C.

(57) ABSTRACT

A myofascial tissue release apparatus includes a base portion. At least two side supports are connected to the base portion and positioned substantially opposite to each other, each of the at least two side supports having a terminating upper surface. At least one fully closed cutout portion is formed in an upper part of each of the at least two side supports in a position below the terminating upper surface. At least one substantially cylindrical bar is removably positioned extending between the at least one fully closed cutout portion of each of the at least two side supports, wherein the at least one substantially cylindrical bar is contactable by a user for use with myofascial tissue release of the user. The apparatus can be used to practice various myofascial tissue release techniques.

20 Claims, 12 Drawing Sheets

(56) References Cited

U.S. PATENT DOCUMENTS

| | | | | |
|---|---|---|---|---|
| 2010/0063429 | A1* | 3/2010 | McClorey | A61H 15/00 601/122 |
| 2012/0203151 | A1* | 8/2012 | Kleiman | A61H 15/00 601/112 |
| 2013/0035217 | A1* | 2/2013 | Beck | A63B 21/4033 482/79 |
| 2016/0279016 | A1* | 9/2016 | McDonald | A61H 1/0292 |
| 2017/0156969 | A1* | 6/2017 | Fitzsimmons | A61H 15/00 |

* cited by examiner

APPARATUS AND METHOD FOR MYOFASCIAL TISSUE RELEASE

CROSS REFERENCE TO RELATED APPLICATION

This application claims benefit of U.S. Provisional Application Ser. No. 62/548,285 entitled, "Apparatus and Method for Myofascial Tissue Release" filed Aug. 21, 2017, the entire disclosure of which is incorporated herein by reference.

FIELD OF THE DISCLOSURE

The present disclosure is generally related to physical therapy and exercise devices and methods and more particularly is related to an apparatus and method for myofascial tissue release.

BACKGROUND OF THE DISCLOSURE

Fascia is a densely woven, covering connective tissue interpenetrating muscles, bones, nerves, arteries, veins, and organs of the human body, which provides a framework that helps support and protect individual muscle groups, organs, and the entire body as a unit. Recently, it has been discovered that physical therapies and related exercise focused on fascia can relieve pain for individuals who have fascia misalignment, which is the underlying fascia tension that is created, maintained, and reinforced through injury and strain patterns of the human body. Fascia misalignment can cause the loss of flexibility or function to parts of the human body, often following an injury or if experiencing ongoing pain in virtually any area containing soft tissue. In turn, this condition can cause tightness of the tissues that restricts motion or pulls the body out of alignment, causing individuals to favor and overuse one hip or shoulder, for example. It can also cause a sense of excessive pressure on muscles or joints that produces pain, as well as other pain, such as headache or back pain.

One therapy to correct this problem is known as myofascial tissue release, which utilizes combinations of stretching and physical exercises to correct fascia misalignment and strengthen incorrect alignment. Myofascial tissue release acts to remove the impediments of the underlying tightness, which allows the muscles having formerly impeded to function and thrive in a healthy fashion. Reversal and alignment methods allow old tightness within the muscles and fascia to release, allowing deeper access to older patterns of physical movement, improved alignment, and additional strength in the new movement pattern. These techniques are often performed with the aid of an exercise device to assist with the stretching and physical movements. However, most devices are designed for use with a single type of technique, which forces a user to buy numerous devices in order to practice the full spectrum of myofascial tissue release techniques. Moreover, conventional exercises are not designed to assist with emerging myofascial tissue release techniques using conditioned movement regimes to penetrate past deep fascial tightness.

Thus, a heretofore unaddressed need exists in the industry to address the aforementioned deficiencies and inadequacies.

SUMMARY OF THE DISCLOSURE

Embodiments of the present disclosure provide a myofascial tissue release apparatus. Briefly described, in architecture, one embodiment of the system, among others, can be implemented as follows. The myofascial tissue release apparatus has a base portion. At least two side supports are connected to the base portion and positioned substantially opposite to each other, each of the at least two side supports having a terminating upper surface. At least one fully closed cutout portion is formed in an upper part of each of the at least two side supports in a position below the terminating upper surface. At least one substantially cylindrical bar is removably positioned extending between the at least one fully closed cutout portion of each of the at least two side supports, wherein the at least one substantially cylindrical bar is contactable by a user for use with myofascial tissue release of the user.

The present disclosure can also be viewed as providing methods of performing myofascial tissue release techniques. In this regard, one embodiment of such a method, among others, can be broadly summarized by the following steps: supporting at least one substantially cylindrical bar on a myofascial tissue release apparatus, wherein the myofascial tissue release apparatus has: a base portion, at least two side supports connected to the base portion and positioned substantially opposite to each other, each of the at least two side supports having a terminating upper surface, and at least one fully closed cutout portion formed in an upper part of each of the at least two side supports in a position below the terminating upper surface; contacting a body part of a user to the at least one substantially cylindrical bar to perform at least one myofascial tissue release technique.

The present disclosure can also be viewed as providing a myofascial tissue release apparatus. Briefly described, in architecture, one embodiment of the system, among others, can be implemented as follows. The myofascial tissue release apparatus has a base portion. At least two side supports are connected to the base portion and positioned substantially opposite to each other, each of the at least two side supports having a terminating upper surface. At least two fully closed cutout portions are formed in an upper part of each of the at least two side supports in a position below the terminating upper surface, the at least two fully closed cutout portions of each of the at least two side supports being vertically and horizontally offset from one another. At least one substantially cylindrical bar is removably positioned extending between opposing fully closed cutout portions of each of the at least two side supports, wherein the at least one substantially cylindrical bar is contactable by a user for use with myofascial tissue release of the user.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
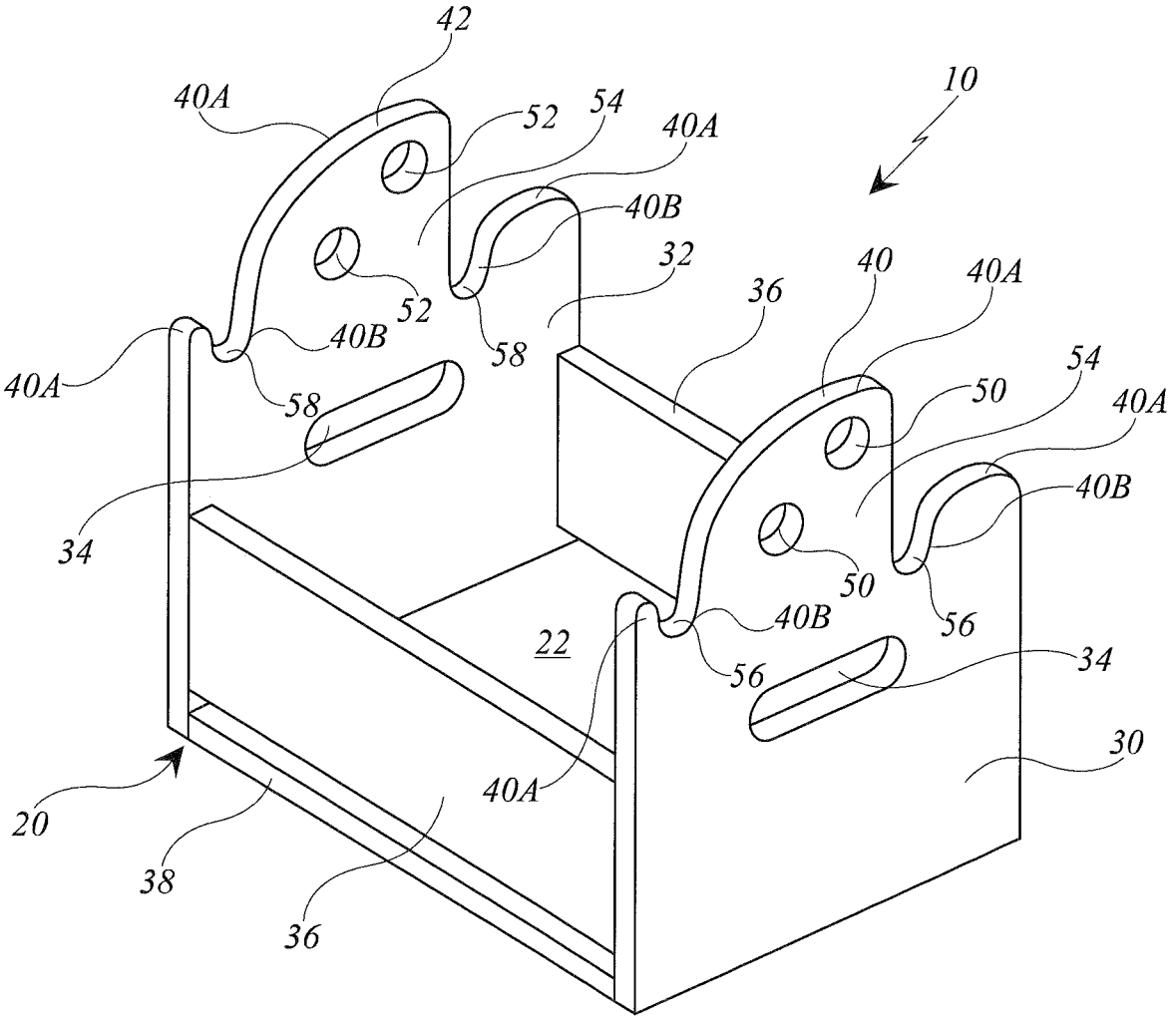
FIG. 1 is an upper isometric view illustration of a myofascial tissue release apparatus, in accordance with a first exemplary embodiment of the present disclosure.
Figure 2:
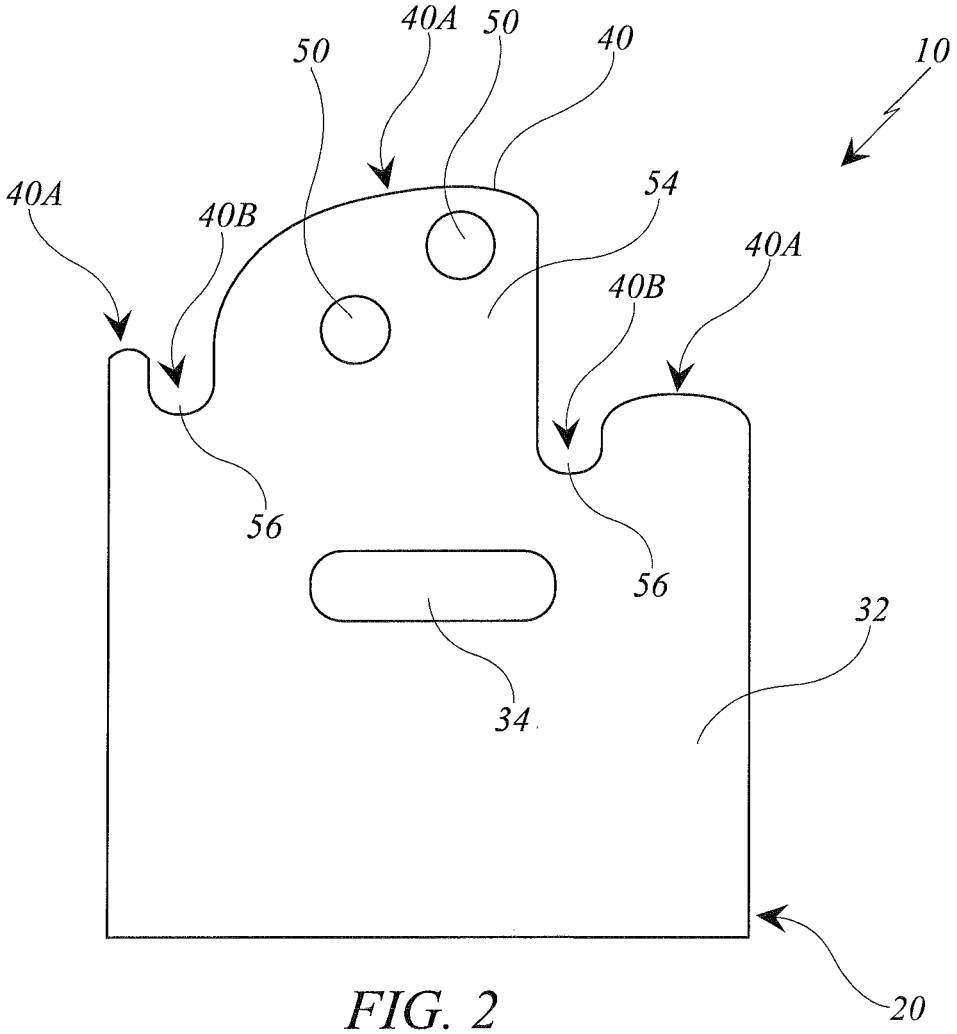
FIG. 2 is a side view illustration of a myofascial tissue release apparatus, in accordance with the first exemplary embodiment of the present disclosure.
Figure 3A:
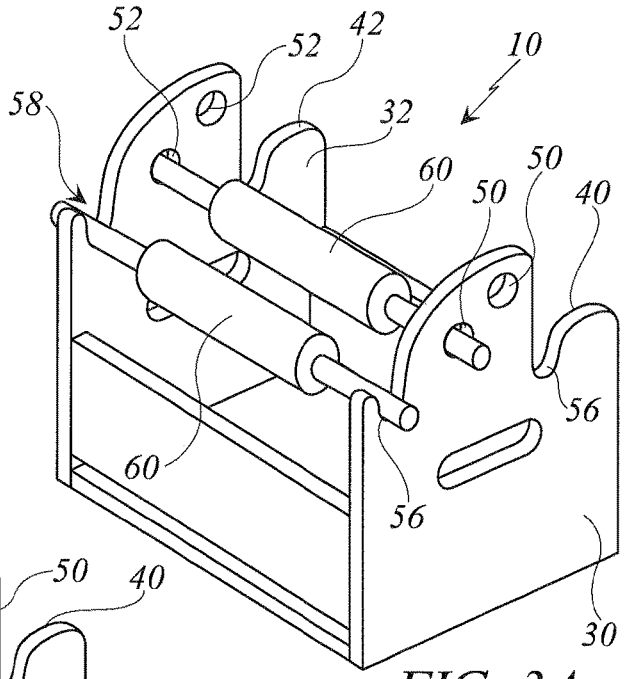
FIGS. 3A-3C are various illustrations of the myofascial tissue release apparatus of FIGS. 1-2 with one type of substantially cylindrical bar, in accordance with the first exemplary embodiment of the present disclosure.
Figure 3B:
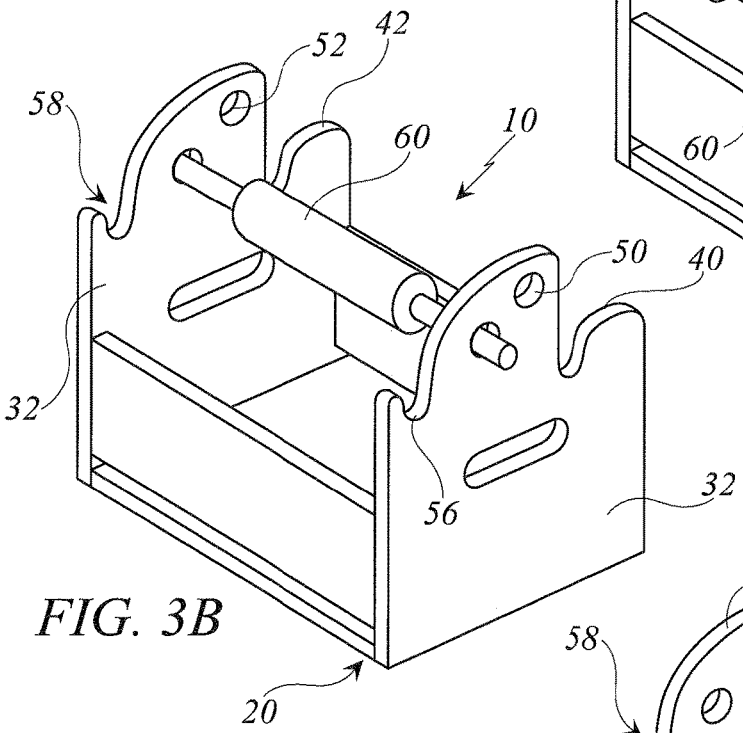
Figure 3C:
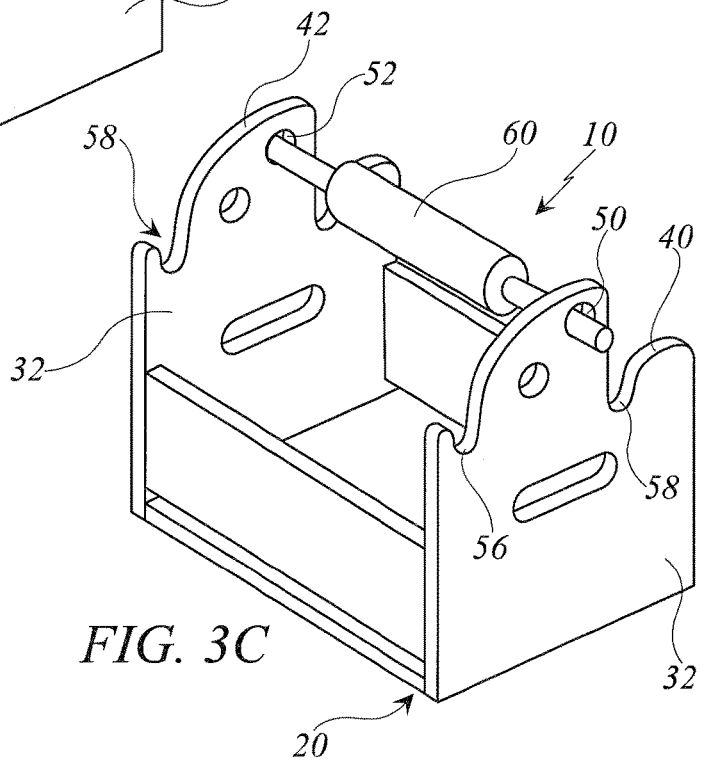

To aid in practicing myofascial tissue release techniques, including those utilizing conditioned movement regimes to penetrate past deep fascial tightness, a myofascial tissue release apparatus and related methods have been developed. FIG. 1 is an upper isometric view illustration of a myofascial tissue release apparatus, in accordance with a first exemplary embodiment of the present disclosure. FIG. 2 is a side view illustration of a myofascial tissue release apparatus, in accordance with the first exemplary embodiment of the present disclosure. FIGS. 3A-3C are various illustrations of the myofascial tissue release apparatus of FIGS. 1-2 with one type of substantially cylindrical bar, in accordance with the first exemplary embodiment of the present disclosure. With reference to FIGS. 1-3A, the myofascial tissue release apparatus 10, which may be referred to herein simply as 'apparatus 10' includes a base portion 20. At least two side supports 30, 32 are connected to the base portion 20 and positioned substantially in opposition to one another. At least two side supports 30, 32 are connected to the base portion 20 and positioned substantially opposite to each other, each of the at least two side supports 30, 32 having a terminating upper surface 40, 42, respectively. At least one fully closed cutout portion 50, 52 is formed in an upper part 54 of each of the at least two side supports 30, 32 in a position below the terminating upper surface 40, 42. At least one substantially cylindrical bar 60 is removably positioned extending between the at least one fully closed cutout portion 50, 52 of each of the at least two side supports 30, 32, wherein the at least one substantially cylindrical bar 60 is contactable by a user for use with myofascial tissue release of the user.

The apparatus 10 may be used to aid with myofascial tissue release techniques where a user positions his or her various body parts, commonly his or her arms, legs, back, or torso on the cylindrical bar 60, or on more than one cylindrical bar 60, to stretch and exercise the body part in an effort to release misalignments of the underlying fascia tissue of that body part. Numerous different exercises can be employed to address myofascial tissue release in particular areas of the body, each of which may utilize various features of the apparatus 10, as is discussed relative to FIGS. 6-11.

Figure 4:
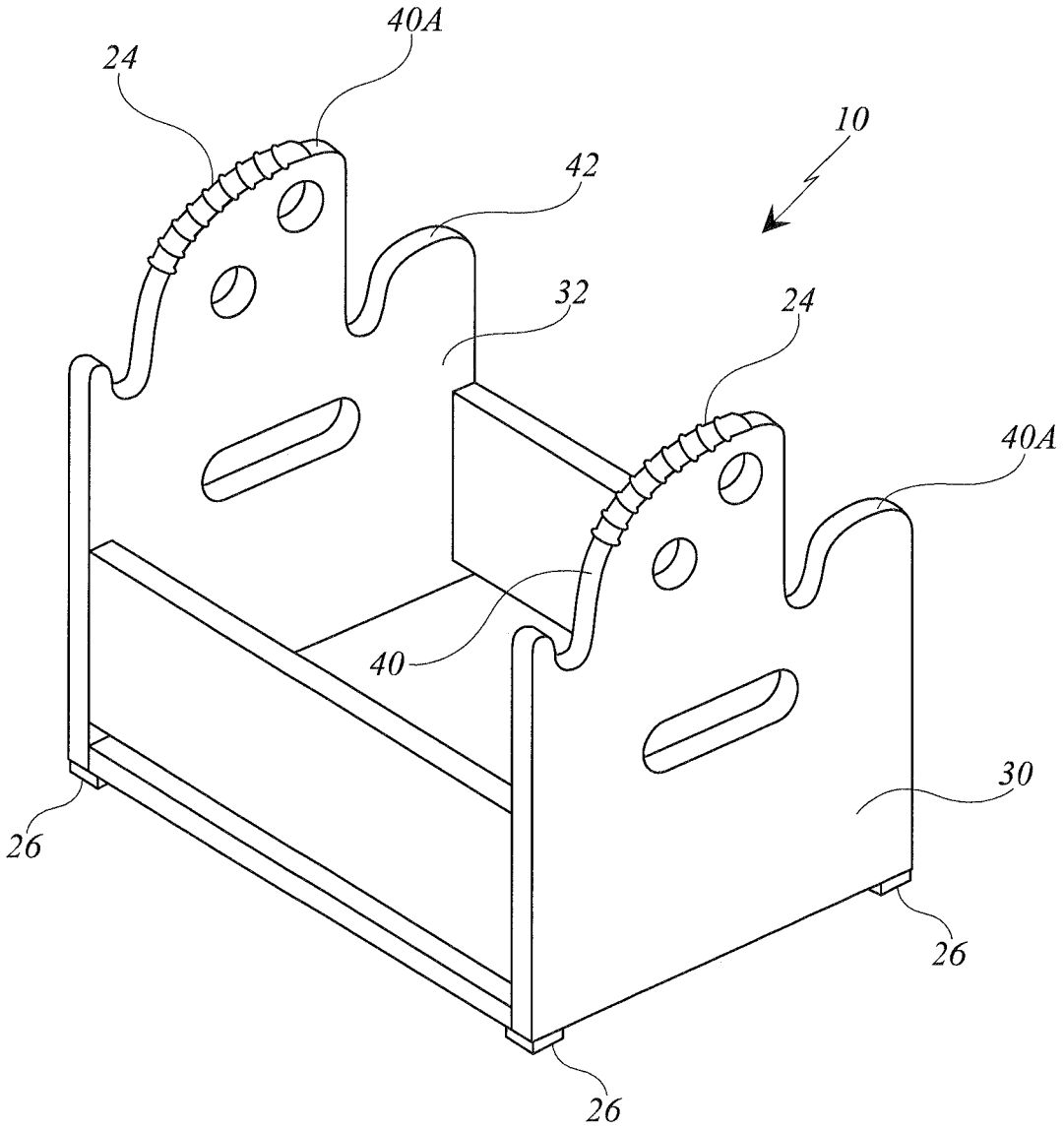
FIG. 4 is an illustration of the myofascial tissue release apparatus 10 of FIGS. 1-3C with a hand grip, in accordance with the first exemplary embodiment of the present disclosure.

With regards to construction, the apparatus 10 may be manufactured from a durable material or materials, including woods, metals, plastics, or other materials, or combinations thereof, to allow for proper durability and structural support of the cylindrical bar 60 during the exercises being conducted on the apparatus 10. Commonly, the base portion 20 of the apparatus 10 may include a substantially flat surface for resting on the ground surface such that the apparatus 10 can remain in a substantially stationary position during use. However, in other designs, the base portion 20 may be formed through the bottom part of the side supports 30, 32, such as the portion of the side supports 30, 32 which is positioned to interface with a ground surface. In either situation, the base portion 20 may include a ground-interfacing material to prevent movement of the apparatus 10, such as rubberized feet or similar structures as is shown in FIG. 4, and/or the base portion 20 may be designed to be used on an exercise mat without causing damage to it. One or more compartments 22 formed within the apparatus 10 between the side supports 30, 32 and lateral sidewalls 36, which may be formed a spaced distance above a floor 38 of the apparatus 10. In some designs, various dividers or organization structures may be included in the compartment 22 to provide storage of accessories or other articles.

The side supports 30, 32 of the apparatus 10 may extend substantially from the ground surface upwards to the terminating upper surface 40, 42 thereof and provide structural, weight-bearing support for weight applied to the top of the apparatus 10. The terminating upper surface 40, 42 of the at least two side supports 30, 32 may be a non-planar surface, such as shown in FIG. 1, where the terminating upper surface 40, 42 has various peak sections 40A and valley sections 40B. Commonly, the side supports 30, 32 will have handles 34 formed therein to aid with transporting or carrying the apparatus 10 by a human user. The handles 34 may have an elongated oval shape to ergonomically fit the fingers of a user. The side supports 30, 32 may be positioned substantially vertical when the base 20 is positioned on a horizontal ground surface, such that the side supports 30, 32 are substantially parallel to one another and the terminating upper surface 40 of one side support 30 can be aligned with the terminating upper surface 42 on the opposing side support 32. In this way, the side supports 30, 32 are positioned in substantially opposition to one another and are symmetrical with one another.

The side supports 30, 32 include a number of features of the apparatus 10. For one, the side supports 30, 32 include the fully closed cutouts 50, 52 which are formed therein for supporting the substantially cylindrical bar. The fully closed cutouts 50, 52 may be characterized as holes or apertures formed fully through a wall thickness of the side supports 30, 32, where the perimeter of the holes or apertures is unbroken, or where any broken portions of the perimeter are sized smaller than a diameter of the bar 60, such that the bar 60 is unable to be removed through the broken perimeter thereof. In other words, the fully closed cutouts 50, 52 have a perimeter which is formed complete and full enough within an interior material of the side supports 30, 32 to prevent the bar 60 from being removed radially therefrom. The fully closed cutouts 50, 52 may be formed within an upper part of each of the side supports 30, 32, such that the substantially cylindrical bar 60 positioned therein may be positioned a spaced height above the floor 38 of the apparatus. It is noted that the use of the fully closed cutouts 50, 52 may be necessary in maintaining the substantially cylindrical bar 60 in the intended position and to prevent inadvertent movement of it. For example, with the fully closed cutouts 50, 52 a user can apply a force on the substantially cylindrical bar 60 in any radial direction along the axis thereof and the substantially cylindrical bar 60 may remain in the position within the fully closed cutouts 50, 52.

In contrast to the fully closed cutouts 50, 52 are open cutouts 56, 58, also referred to as non-fully closed cutouts, which may also be included in the side supports 30, 32. Open cutouts 56, 58 have at least part of their internal perimeter open to another surface. For example, the open cutouts 56, 58 depicted in FIG. 1 have a radial surface which is integral with the terminating upper surface 40, 42 of the side supports 30, 32. While these open cutouts 56, 58 can retain the substantially cylindrical bar 60 when radial forces are applied to it in many directions, any substantially vertical forces applied to the bar 60 will remove the bar 60 from the open cutouts 56, 58. Thus, the use of fully closed cutouts 50, 52 provides substantial benefits to the apparatus 10.

While the shape of the fully closed cutouts 50, 52 or the open cutouts 56, 58 may vary, in one example, the fully closed cutouts 50, 52 are circular cutouts, whereas the open cutouts 56, 58 have a radial shape which has an inwardly curved or concave shape within the terminating edge of the side supports 30, 32. The fully closed cutouts 50, 52 or the open cutouts 56, 58 may also have other designs, such as square cutouts, hexagonal cutouts, cutouts with other linear or non-linear outlines, or any combination thereof.

It is noted that both the fully closed cutouts 50, 52 and the open cutouts 56, 58 may be used for supporting the bar 60, depending on the particular exercise or technique being employed. The fully closed cutouts 50, 52 may provide increased stabilization of the bar 60 during many techniques, and the open cutouts 56, 58 may be used for supporting the bar 60 with less stabilization. Both the fully closed cutouts 50, 52 and the open cutouts 56, 58 may keep the bar 60 in place without the need for fasteners or retention devices. Similarly, both the fully closed cutouts 50, 52 and the open cutouts 56, 58 may provide sufficient stability for the bar 60 during use of the apparatus 10, of course, depending on the particular exercise, but they also allow for quick and convenient removal or repositioning of the bar 60 to other cutouts 50, 52, 56, 58 within the side supports 30, 32 so as not to hinder the efficiency with which a user transitions between different exercise techniques.

Any number of fully closed cutouts 50, 52 or open cutouts 56, 58 can be included in each side support 30, 32. For example, FIG. 1 illustrates an example with two fully closed cutouts 50 within side support 30 along with two open cutouts 56, 58. The open cutouts 56, 58 may include radial cutout shapes having any size or radius, where the side supports of the open cutouts 56, 58 extend substantially above a center point thereof, or the open cutouts 56, 58 may include small circumference radial cutouts where the radial center point is located above the upper edge of the cutout itself. Both the fully closed cutouts 50, 52 and the open cutouts 56, 58 may be designed to interface with cylindrical bars 60 having different sizes and diameters. For example, this may include bars 60 with diameters sized small enough to fit within the fully closed cutouts 50, 52 or bars 60 sized larger than the diameter of the open cutouts 56, 58, such that the bar 60 can only be partially positioned within the open cutouts 56, 58.

As is evident, the number, size, design, and configurations of the fully closed cutouts 50, 52 and the open cutouts 56, 58 can vary depending on the design of the apparatus 10 and on the intended exercise to be practiced on the apparatus. For example, the open cutouts 56, 58 may be slightly overlapping one another, such as when the radial curve of one cutout forms the radial curve of a separate cutout. Moreover, the open cutouts 56, 58 may be positioned to allow movement of the cylindrical bar 60 in only certain directions. For example, open cutouts 56, 58 in FIG. 1 may be design to prevent movement of the cylindrical bar 60 in the vertical direction.

With regards to the fully closed cutouts 50, 52, it is noted that when two fully closed cutouts 50, 52 are included, such as is shown in FIG. 1, both of the cutouts 50, 52 are formed in the two side supports 30, 32, respectively, and are vertically offset from one another, such that one of the fully closed cutouts 50, 52 is positioned higher than the other. Similarly, the fully closed cutouts 50, 52 may be horizontally offset, or both horizontally and vertically offset, as shown in FIG. 1. It is also noted that one or both of the fully closed cutouts 50, 52 may be vertically and/or horizontally offset from the open cutouts 56, 58. This design may allow the user to employ more than one bar 60 at once, such as where two small diameter bars 60 are positioned extending between the side supports 30, 32 and a user can position his or her arm or leg between them. This ability may be particularly beneficial to providing contact between more than one part of the user's arm or leg simultaneously by the bars 60. In this regard, the orientation of the open cutouts 56, 58 may control the freedom of movement of the cylindrical bar 60 within the open cutouts 56, 58, the specific position of which may be designed to provide for specific exercises. For example, where a user appendage is between two bars 60, one positioned in a fully closed cutout 50, 52, and the other positioned in the open cutout 56, 58, the user can apply a downward force on one (the bar 60 in the open cutouts 56, 58) and an upwards force on the other (the bar 60 in the fully closed cutout 50, 52). Of course, other variations on the exercises may necessitate other positions or configurations of the bars 60.

The specific locations of the cutouts 50, 52, 56, and 58 may be selected to facilitate holding the bar 60 in specific positions for certain exercises. For example, upper part of each of the at least two side supports 30, 32 which has the fully closed cutouts 50, 52 is commonly formed in the at least one peak section 40A such that the bar 60 can be retained towards a top height of the apparatus 10. Similarly, the valley section 40B in the side supports 30, 32 may include the open cutout 56, 58, such that the open cutout 56, 58 has an interior cutout surface formed from the terminating upper surface 42. Here, the sidewall of each of the at least two side supports 30, 32 may be positioned higher than the open cutout 56, 58.

It is noted that the substantially cylindrical bar 60 may include various types of exercise bars. Generally, the bar 60 may include a rigid bar or center which provides rigidity and support, and which is covered in padded material along its exterior middle portion. The diameter of the rigid bar at the terminating ends thereof, e.g., where the bar 60 engages with the cutouts 50, 52, 56, 58 is sized smaller than an interior diameter of the cutouts 50, 52, 56, 58, which allows it to fit within the cutouts 50, 52, 56, 58. The bar 60 may have any type of padding, surface texturing, be constructed from any type of material, and have a variety of lengths, thicknesses, and other dimensions.

FIG. 4 is an illustration of the myofascial tissue release apparatus 10 of FIGS. 1-3C with a hand grip 24, in accordance with the first exemplary embodiment of the present disclosure. As shown, the hand grip 24 may be positioned on the terminating upper edge 40, 42 of each of the side supports 30, 32, such that the user can utilize the peak section 40A of the side supports 30, 32 as a height-bearing hand hold. The hand grip 24 may include an ergonomic material, such as plastic, rubber, or a similar material, which is affixed to the peak section 40A. Also shown in FIG. 4 are ground-interfacing materials 26 positioned on the base 20 of the apparatus 10. The ground-interfacing materials 26 are used to prevent movement of the apparatus 10, and they may include rubberized feet or similar structures.

Figure 5:
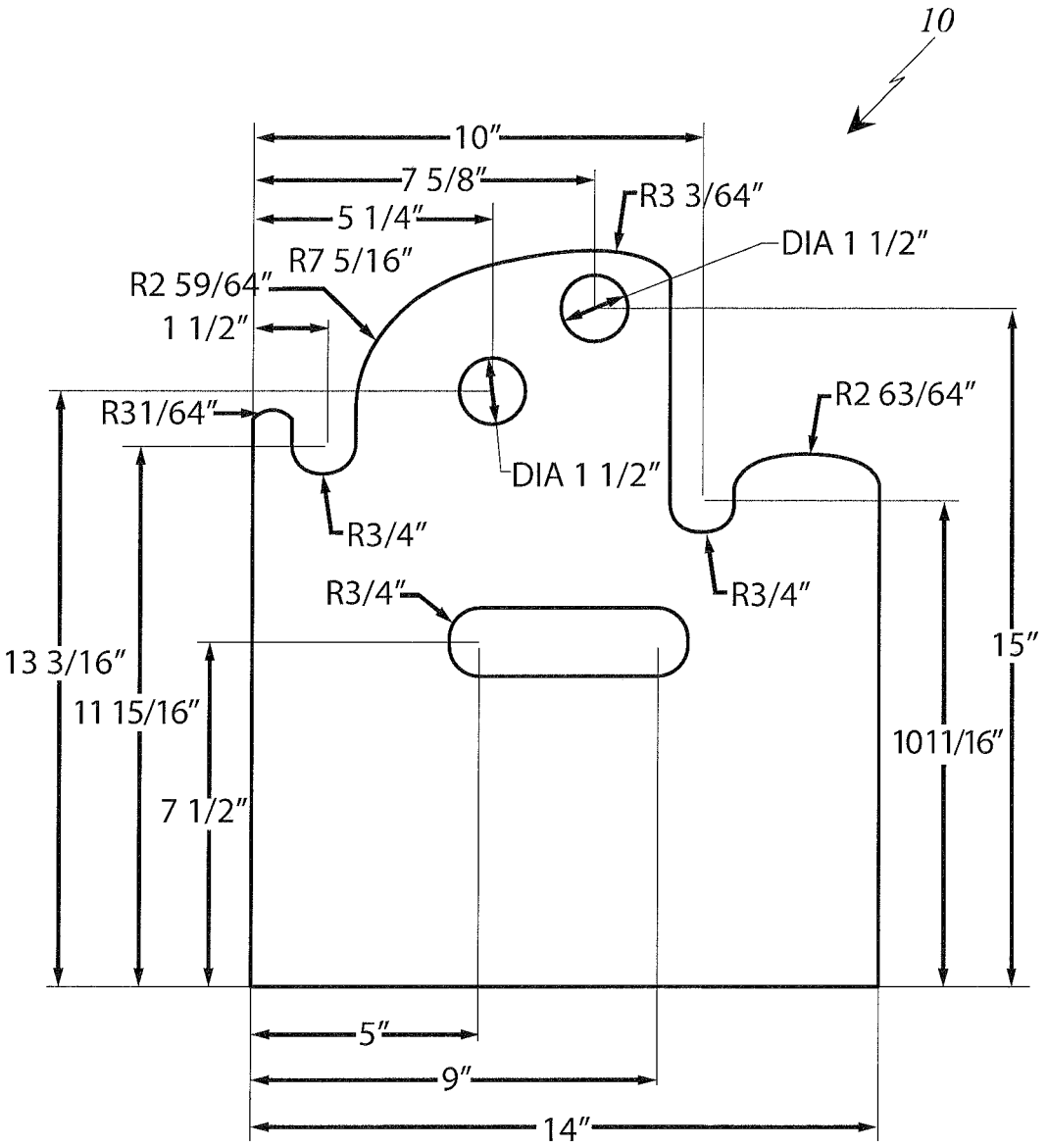
FIG. 5 is a schematic dimensional diagram of the myofascial tissue release apparatus of FIGS. 1-4, in accordance with the first exemplary embodiment of the present disclosure.

FIG. 5 is a schematic dimensional diagram of the myofascial tissue release apparatus 10 of FIGS. 1-4, in accordance with the first exemplary embodiment of the present disclosure. While the specific sizes and dimensions of the apparatus 10 and features/components thereof may vary, FIG. 5 provides one example of the sizing and dimensions of the apparatus 10, the values of which are labeled within the figure.

Figure 6:
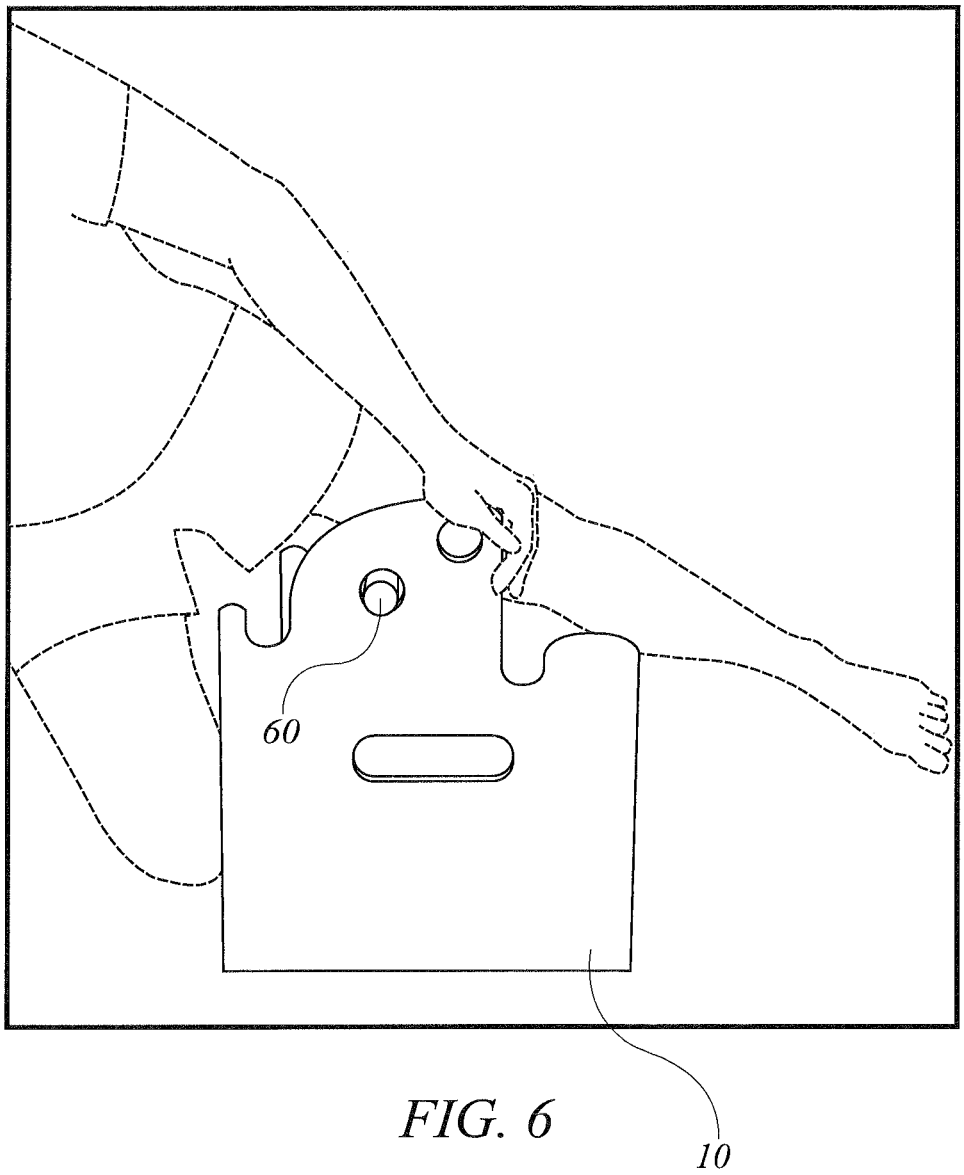
FIGS. 6-11 are illustrations of a user employing the apparatus to conduct various myofascial tissue release exercise techniques.
Figure 7:
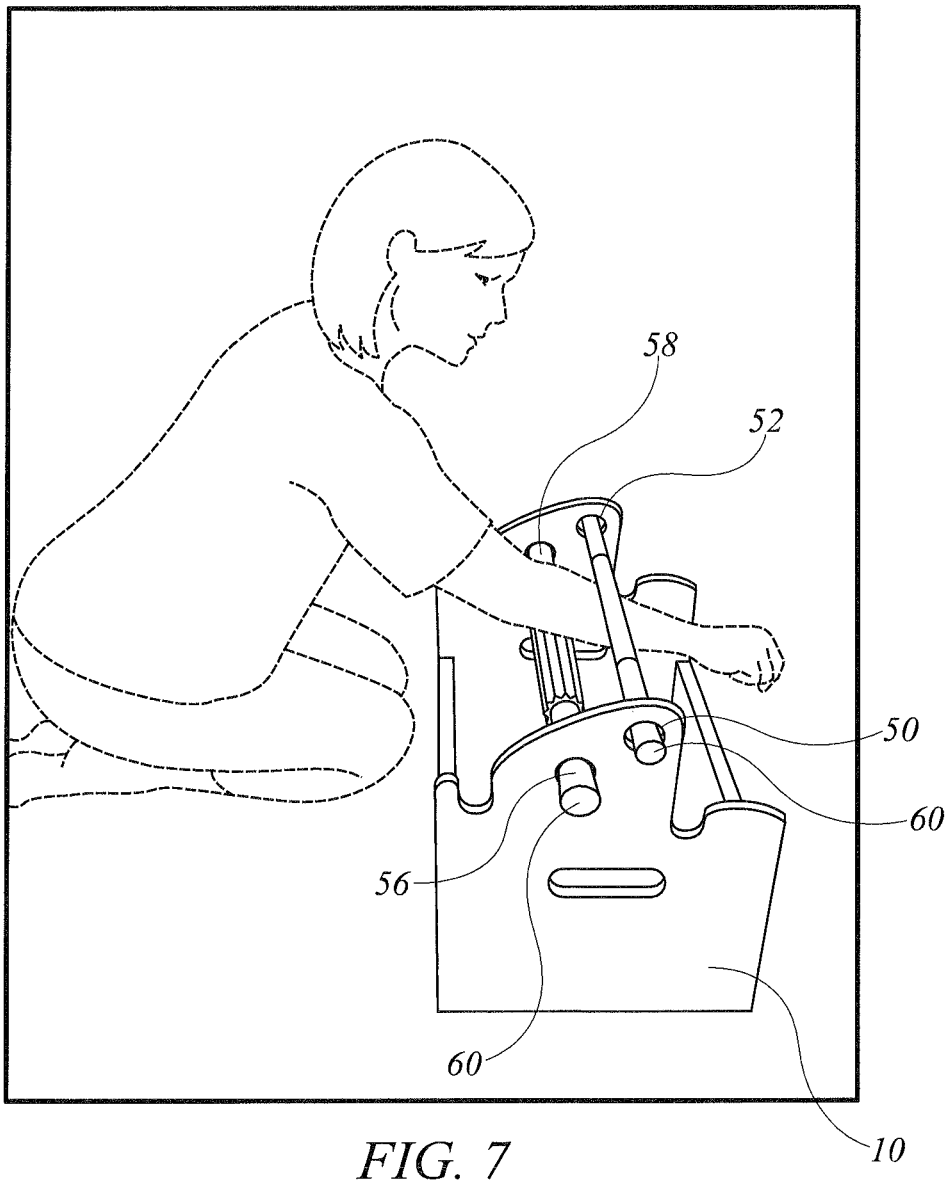
Figure 8:
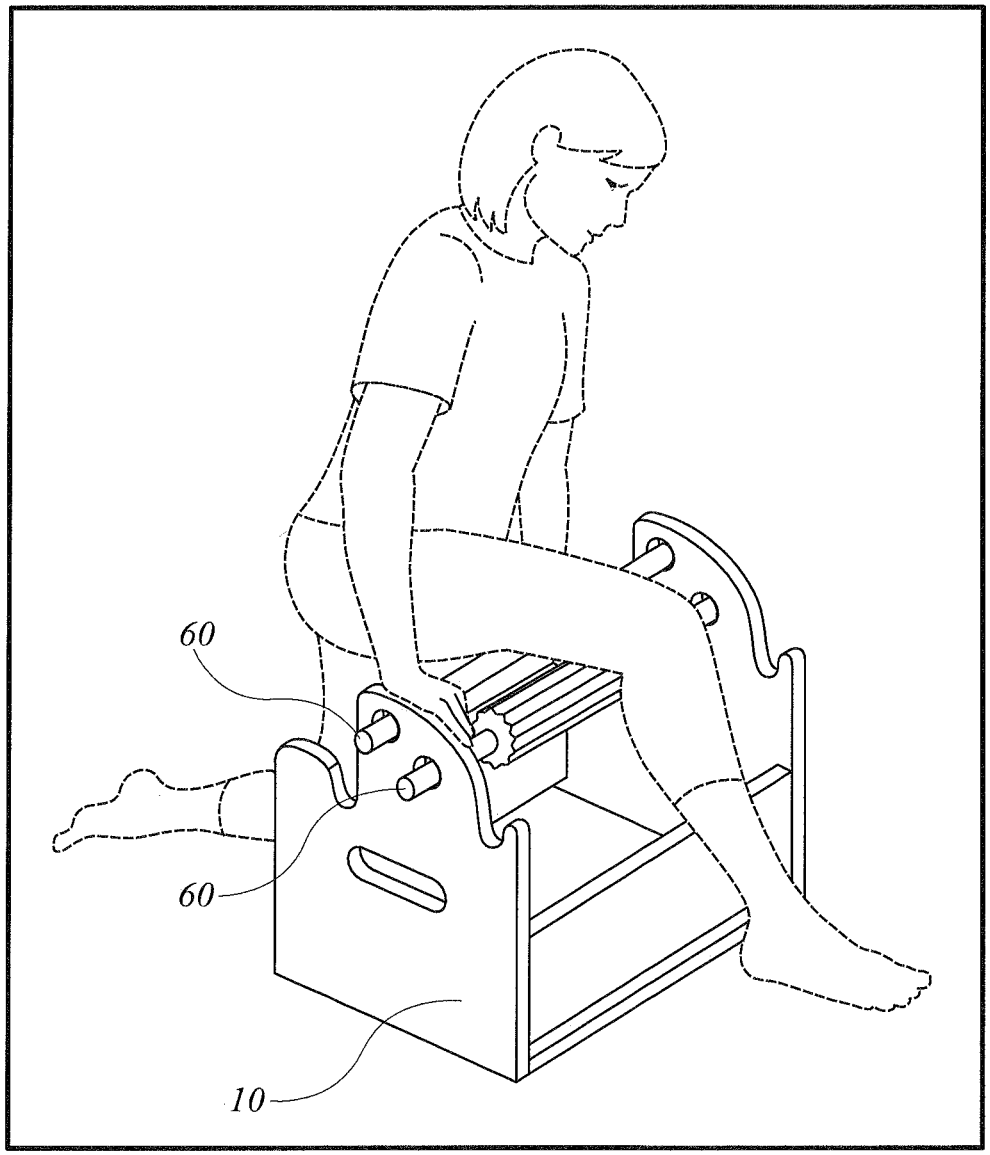
Figure 9:
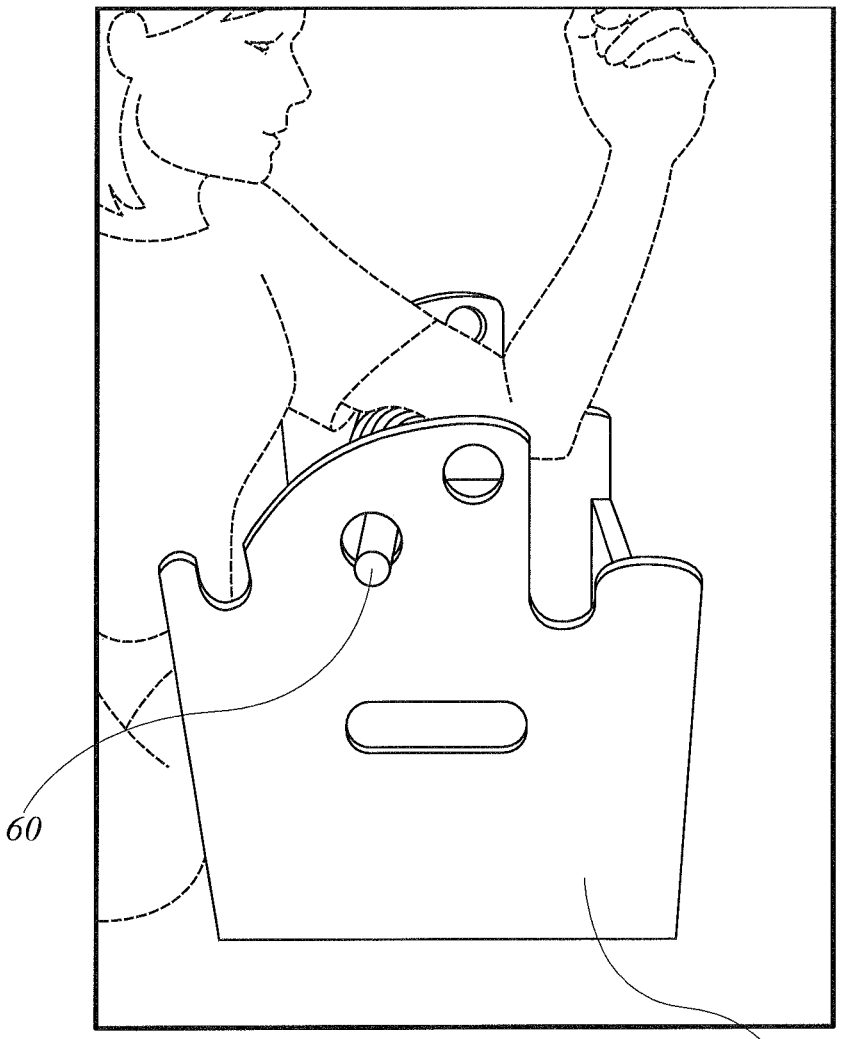
Figure 10:
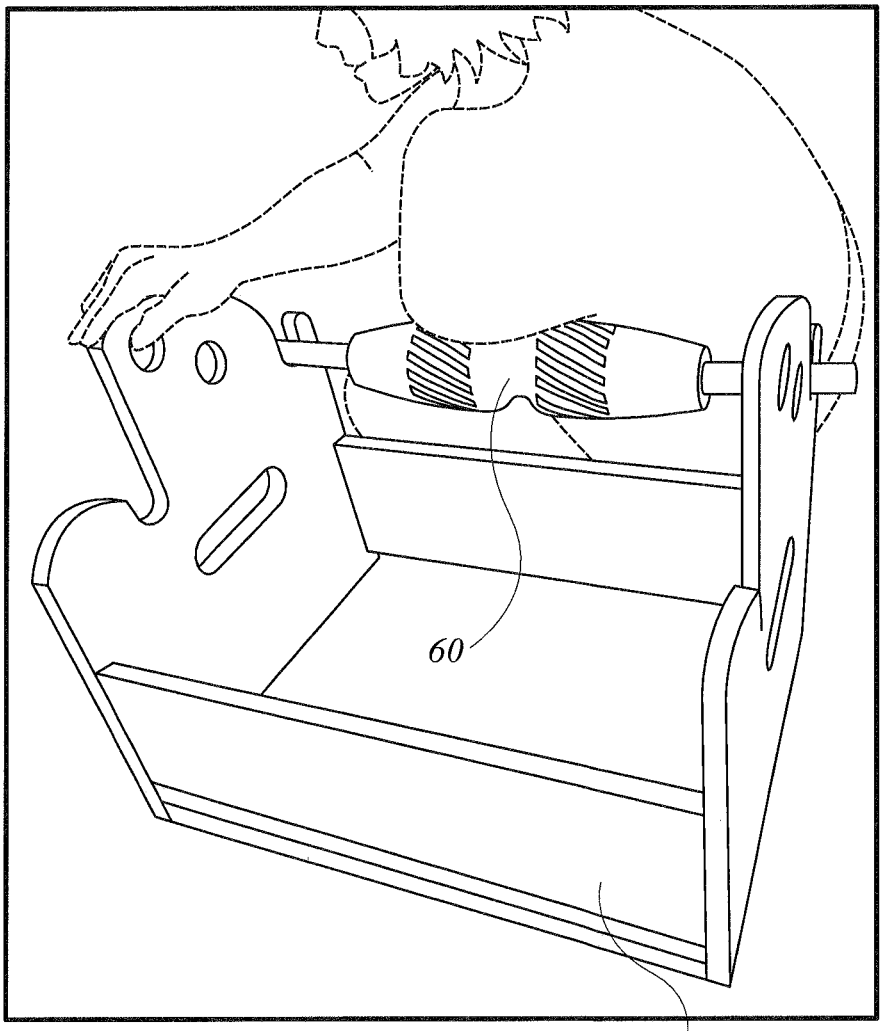
Figure 11:
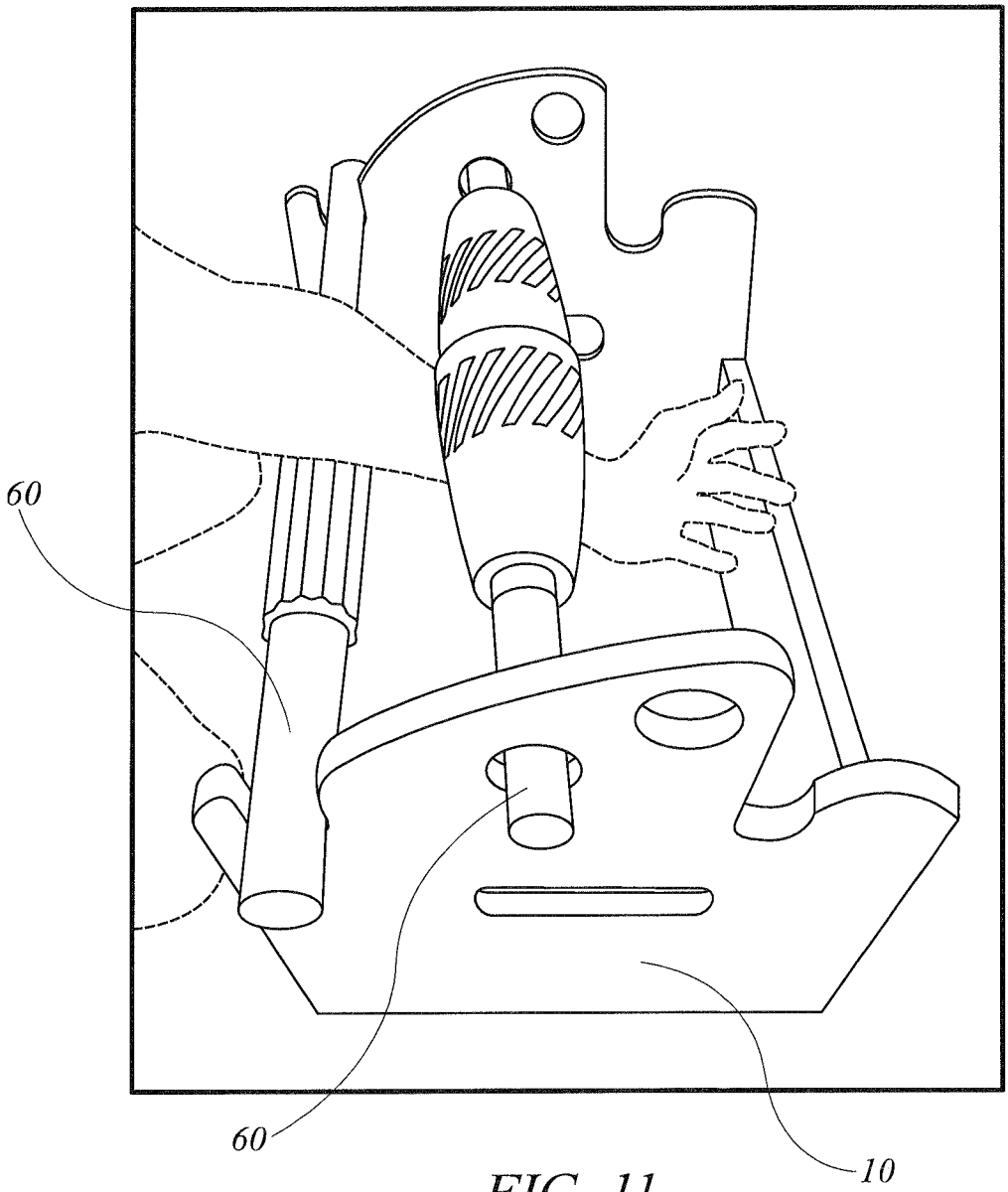

As previously noted, the particular exercises which can be practiced with the apparatus 10 can vary widely. Users can employ the apparatus 10 for exercises involving the legs, the arms, the back, the torso, or other body parts, or combinations thereof. FIGS. 6-11 are photographs illustrating a user employing the apparatus 10 to conduct various myofascial tissue release exercise techniques. For example, FIG. 6 is an illustration of the apparatus 10 being used with an adductor release technique, where the user contacts the bar 60 along her adductor muscle and conducts the appropriate exercise movements. FIG. 7 is an illustration of the apparatus 10 being used with a forearm release, where the user places her forearm between two bars 60, one positioned within the fully closed cutouts 50, 52, and the other positioned within the open cutouts 56, 58. FIG. 8 is an illustration of the apparatus 10 being used with a hamstring release, where the user kneels proximate to the apparatus 10 and places her hamstring muscle above one of the bars 60. FIG. 9 is an illustration of the apparatus 10 being used with a triceps release, where the user places her triceps muscle above one of the bars 60 and conducts the exercise movement. FIG. 10 is an illustration of the apparatus 10 being used with a deltoid release, where the user places her deltoid muscle against the bar 60 and conducts the exercise. FIG. 11 is an illustration of the apparatus 10 being used with an anterior forearm release, where the user places her forearm between two bars 60 and moves it between the two bars 60.

The apparatus 10 may be used to facilitate many other myofascial tissue release techniques and exercises, as one skilled in the art would recognize. These various exercises facilitate Self-Myofascial-Release (SMR) of the fascia in the parts of the body which are subjected to the techniques, where the SMR can relieve chronic patterns of fascial thickening caused by repetitive action. By providing multidirectional pressure against one bar or between two bars, the apparatus 10 can provide deep and dynamic release. These various techniques include exercises for facilitating SMR on the forearm, in the upper arm, specifically the triceps and triceps tendon, such as with rotational techniques (cross-fiber) to maximize the results of the exercise, the biceps brachii and coracoid brachialis, the distal fibers of the pectoralis major, the calves & ankle, the adductor group, the hamstring, the rotator cuff & posterior shoulder, the upper arm and deltoid, the upper aiizi and tendon of the triceps brachaii and tissue adjacent to the elbow, the lower leg, the thigh, with fascia in the forearm, and many other body parts.

Figure 12:
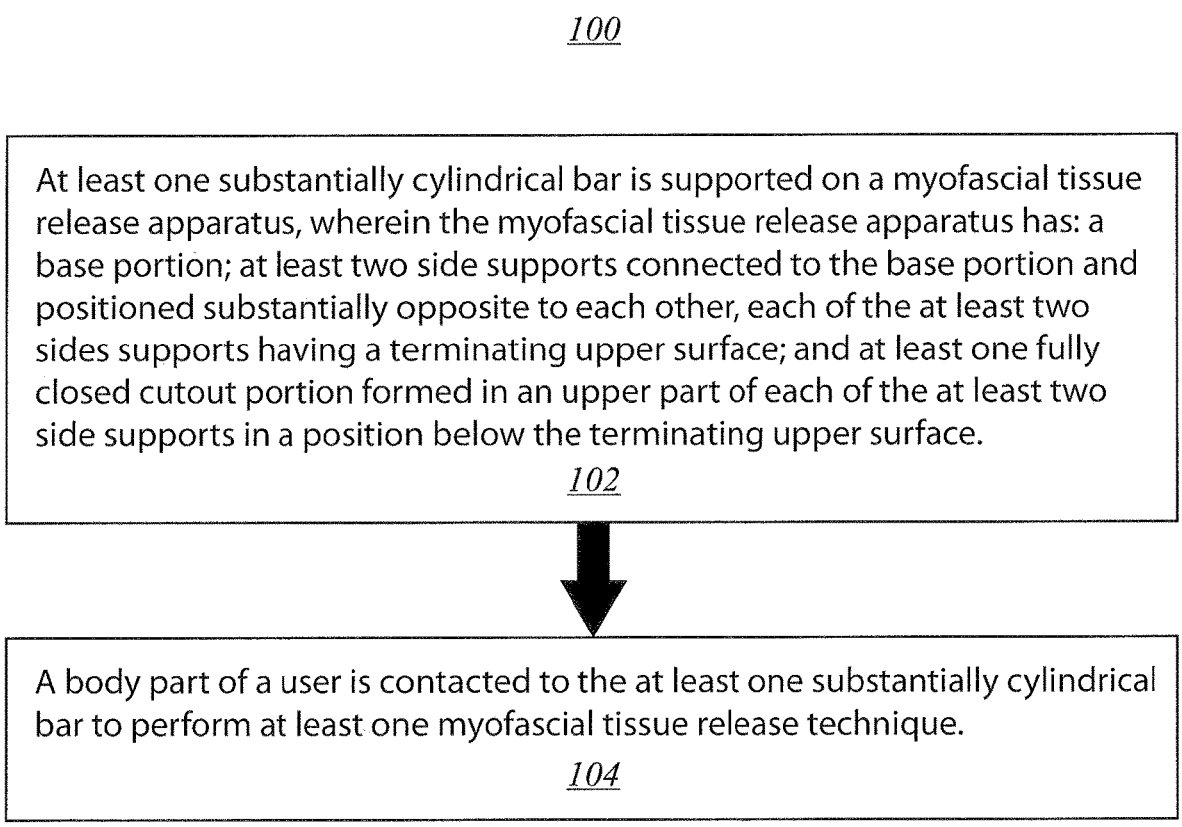
FIG. 12 is a flowchart illustrating a method of performing myofascial tissue release techniques in accordance with the first exemplary embodiment of the disclosure.

FIG. 12 is a flowchart 100 illustrating a method of performing myofascial tissue release techniques in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, at least one substantially cylindrical bar is supported on a myofascial tissue release apparatus, wherein the myofascial tissue release apparatus has: a base portion; at least two side supports connected to the base portion and positioned substantially opposite to each other, each of the at least two side supports having a terminating upper surface; and at least one fully closed cutout portion formed in an upper part of each of the at least two side supports in a position below the terminating upper surface. A body part of a user is contacted to the at least one substantially cylindrical bar to perform at least one myofascial tissue release technique (block 104). The method may include any features, variations, structures, or functions disclosed relative to any figure in this disclosure, all of which are considered within the scope of the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claim.

What is claimed is:

1. A myofascial tissue release apparatus for myofascial tissue release in the legs or arms, the myofascial tissue release apparatus comprising:

a base portion;

at least two side supports connected to the base portion and positioned substantially opposite to each other, each of the at least two side supports having a terminating upper surface;

at least one fully closed cutout portion formed in an upper part of each of the at least two side supports in a position below the terminating upper surface; at least one open cutout portion formed within each of the at least two side supports in a position below the upper part of each of the at least two side supports, the at least one open cutout portion having an interior cutout surface formed from the terminating upper surface along a bottom and sides of the at least one open cutout portion, wherein the at least one open cutout portion is positioned fully below the at least one fully closed cutout portion; and at least two substantially cylindrical bars, a first of the at least two substantially cylindrical bars removably positioned and extending between the at least one fully closed cutout portion of each of the at least two side supports, the first of the at least two substantially cylindrical bars is prevented from inadvertent movement by the at least one fully closed cutout portion and remains in a position within the at least one fully closed cutout portion when a force is applied in any radial direction against the first of the at least two substantially cylindrical bars, and a second of the at least two substantially cylindrical bars removably positioned and extending between the at least one open cutout portion of each of the at least two side supports and retained by and within the at least one open cutout portion when a force is applied in downward and lateral radial directions against the second of the at least two substantially cylindrical bars, wherein the at least two substantially cylindrical bars are contacted by a body part of a user, whereby the body part is positioned between the at least two substantially cylindrical bars and applies opposing forces on the at least two substantially cylindrical bars simultaneously, respectively, whereby contact between the at least two substantially cylindrical bars and the body part provides myofascial tissue release of the body part of the user.

2. The myofascial tissue release apparatus of claim 1, wherein the at least one fully closed cutout portion further comprises at least two fully closed cutout portions, both formed in the upper part of each of the at least two side supports, wherein the at least two fully closed cutout portions are vertically offset from one another.

3. The myofascial tissue release apparatus of claim 1, wherein the at least two substantially cylindrical bars each further comprises a rigid bar having a padded exterior middle portion, wherein a diameter of the rigid bar at terminating ends thereof is sized smaller than an interior diameter of the at least one fully closed cutout portion.

4. The myofascial tissue release apparatus of claim 1, wherein the terminating upper surface of the at least two side supports further comprises a non-planar surface.

5. The myofascial tissue release apparatus of claim 4, wherein the non-planar surface further comprises at least one peak section and at least one valley section.

6. The myofascial tissue release apparatus of claim 5, wherein the upper part of each of the at least two side supports is formed in the at least one peak section.

7. The myofascial tissue release apparatus of claim 6, further comprising at least a hand grip positioned on the terminating upper surface in a location on the at least one peak section.

8. The myofascial tissue release apparatus of claim 5, wherein the at least one valley section further comprises the at least one open cutout portion.

9. The myofascial tissue release apparatus of claim 1, wherein a sidewall of each of the at least two side supports is positioned higher than the at least one open cutout portion.

10. The myofascial tissue release apparatus of claim 1, wherein the at least one fully closed cutout portion further comprises a circular hole formed through each of the at least two side supports.

11. A method of performing myofascial tissue release techniques on a leg or an arm, the method comprising:

supporting at least two substantially cylindrical bars on a myofascial tissue release apparatus, wherein the myofascial tissue release apparatus has:

a base portion;

at least two side supports connected to the base portion and positioned substantially opposite to each other, each of the at least two side supports having a terminating upper surface;

at least one fully closed cutout portion formed in an upper part of each of the at least two side supports in a position below the terminating upper surface; and at least one open cutout portion formed within each of the at least two side supports in a position below the upper part of each of the at least two side supports, the at least one open cutout portion having an interior cutout surface formed from the terminating upper surface along a bottom and sides of the at least one open cutout portion, wherein the at least one open cutout portion is positioned fully below the at least one fully closed cutout portion;

wherein a first of the at least two substantially cylindrical bars is removably positioned and extending between the at least one fully closed cutout portion of each of the at least two side supports, the first of the at least two substantially cylindrical bars is prevented from inadvertent movement by the at least one fully closed cutout portion and remains in a position within the at least one fully closed cutout portion when a force is applied in any radial direction against the first of the at least two substantially cylindrical bars, and a second of the at least two substantially cylindrical bars is removably positioned extending between the at least one open cutout portion of each of the at least two side supports and retained by and within the at least one open cutout portion when a force applied downward and lateral radial against the second of the at least two substantially cylindrical bars; and performing at least one myofascial tissue release technique on a body part of a user by contacting the body part of the user to the at least two substantially cylindrical bars, whereby the body part is positioned between the at least two substantially cylindrical bars and the body part applies opposing forces on the at least two substantially cylindrical bars simultaneously, respectively, whereby contact between the at least two substantially cylindrical bars and the body part provides myofascial tissue release of the body part of the user.

12. The method of claim 11, wherein the at least one fully closed cutout portion further comprises at least two fully closed cutout portions, both formed in the upper part of each of the at least two side supports, wherein the at least two fully closed cutout portions are vertically offset from one another.

13. The method of claim 11, wherein the at least two substantially cylindrical bars each further comprises a rigid bar having a padded exterior middle portion, wherein a diameter of the rigid bar at terminating ends thereof is sized smaller than an interior diameter of the at least one fully closed cutout portion.

14. The method of claim 11, wherein the terminating upper surface of the at least two side supports further comprises a non-planar surface.

15. The method of claim 14, wherein the non-planar surface further comprises at least one peak section and at least one valley section.

16. The method of claim 15, wherein the upper part of each of the at least two side supports is formed in the at least one peak section.

17. The method of claim 16, further comprising at least a hand grip positioned on the terminating upper surface in a location on the at least one peak section.

18. A myofascial tissue release apparatus for myofascial tissue release in the legs or arms, the myofascial tissue release apparatus comprising:

a base portion;

at least two side supports connected to the base portion and positioned substantially opposite to each other, each of the at least two side supports having a terminating upper surface;

at least two fully closed cutout portions formed in an upper part of each of the at least two side supports in a position below the terminating upper surface, the at least two fully closed cutout portions of each of the at least two side supports being vertically and horizontally offset from one another;

at least two open cutout portions formed within each of the at least two side supports in a position below the upper part of each of the at least two side supports, the at least two open cutout portions having an interior cutout surface formed from the terminating upper surface along a bottom and sides of the at least two open cutout portions, wherein the at least two open cutout portions are both positioned fully below the at least two fully closed cutout portions; and at least four substantially cylindrical bars, wherein a first substantially cylindrical bar of the at least four substantially cylindrical bars removably positioned and extending between a first of the at least two fully closed cutout portions of each of the at least two side supports and is prevented from inadvertent movement by the first of the at least two fully closed cutout portions and remain within the first of the at least two fully closed cutout portions when a force is applied in any radial direction against the first substantially cylindrical bar;

a second substantially cylindrical bar of the at least four substantially cylindrical bars removably positioned and extending between a second of the at least two fully closed cut out portions of each of the at least two side supports and is prevented from inadvertent movement by the second of the at least two fully closed cutout portions and remain within the second of the at least two fully closed cutout portions when a force is applied in any radial direction against the second substantially cylindrical bar;

a third substantially cylindrical bar of the at least four substantially cylindrical bars removably positioned and extending between a first of the at least two open cutout portions of each of the at least two side supports, and the third substantially cylindrical bar is retained by and within the first of the at least two open cutout portions when a force is applied in downward and lateral radial directions against the third substantially cylindrical bar;

a fourth substantially cylindrical bar of the at least four substantially cylindrical bars removably positioned and extending between a second of the at least two open cutout portions of each of the at least two side supports, and the fourth substantially cylindrical bar is retained by and within the second of the at least two open cutout portions when a force is applied in downward and lateral radial directions against the fourth substantially cylindrical bar; and wherein at least two of the at least four substantially cylindrical bars are simultaneously contactable by a user for use with myofascial tissue release of the user.

19. The myofascial tissue release apparatus of claim 18, wherein a gap is formed between the first and second substantially cylindrical bars, between the first and third substantially cylindrical bars, between the first and fourth substantially cylindrical bars, between the second and third substantially cylindrical bars, or between the second and fourth substantially cylindrical bars;

whereby the body part of the user is positionable between the gap and able to contact the respective substantially cylindrical bars that form the gap simultaneously to thereby perform at least one myofascial tissue release technique.

20. The myofascial tissue release apparatus of claim 1, further comprising two lateral sidewalls, each connected to the base portion and to the at least two side supports, wherein the two lateral sidewalls, the base portion, and the at least two side supports form an open-top storage receptacle.

* * * * *